US010501874B2

(12) United States Patent
Kostian

(10) Patent No.: US 10,501,874 B2
(45) Date of Patent: Dec. 10, 2019

(54) KNITTED PART

(71) Applicant: medi GmbH & Co. KG, Bayreuth (DE)

(72) Inventor: Stefan Kostian, Fichtelberg (DE)

(73) Assignee: MEDI GMBH & CO. KG, Bayreuth (DE)

( * ) Notice: Subject to any disclaimer, the term of this patent is extended or adjusted under 35 U.S.C. 154(b) by 203 days.

(21) Appl. No.: 15/492,183

(22) Filed: Apr. 20, 2017

(65) Prior Publication Data

US 2017/0335495 A1 Nov. 23, 2017

(30) Foreign Application Priority Data

May 19, 2016 (EP) ..... 16170264

(51) Int. Cl.

| | |
|---|---|
| ***D04B 1/26*** | (2006.01) |
| ***D04B 1/10*** | (2006.01) |
| ***D04B 1/18*** | (2006.01) |
| ***D04B 1/12*** | (2006.01) |
| ***D04B 1/24*** | (2006.01) |

(52) U.S. Cl.

CPC ..... *D04B 1/265* (2013.01); *D04B 1/102* (2013.01); *D04B 1/123* (2013.01); *D04B 1/18* (2013.01); *D04B 1/243* (2013.01); *D04B 1/104* (2013.01)

(58) Field of Classification Search

CPC ..... D04B 1/265; D04B 1/102; D04B 1/123; D04B 1/18; D04B 1/243

See application file for complete search history.

(56) References Cited

U.S. PATENT DOCUMENTS

| | | | | |
|---|---|---|---|---|
| 2,015,608 A | | 9/1935 | Southwick | |
| 2,052,088 A | * | 8/1936 | Drumheller | D04B 1/18 66/190 |
| 2,269,088 A | * | 1/1942 | Fleer | D04B 9/54 66/172 R |
| 2,986,025 A | * | 5/1961 | Cormier | D04B 1/26 66/172 E |
| 3,159,990 A | * | 12/1964 | Monday | D04B 9/54 66/172 E |
| 3,392,552 A | * | 7/1968 | Muller | D04B 1/10 66/169 R |

(Continued)

FOREIGN PATENT DOCUMENTS

| | | |
|---|---|---|
| EP | 0919145 A1 | 6/1999 |
| GB | 2029468 A | 3/1980 |
| WO | 2012028795 A1 | 3/2012 |

*Primary Examiner* — Danny Worrell

(74) *Attorney, Agent, or Firm* — Lucas & Mercanti, LLP; Klaus P. Stoffel

(57) ABSTRACT

A knitted part flat-knitted from at least one knitting thread, said knitted part including a ground fabric portion having a plurality of ground fabric courses, and also at least one wave portion which extends across a plurality of wales, which include a plurality of wave portion courses and in which, in each case, a loop has been knitted in a first wale in a first wave portion course and every further wave portion course, whereas, in each case, in an adjacent second wale, a loop knitted in the first wave portion course extends across a plurality of wave portion courses, wherein at least one elastic weft thread runs through at least a portion of the ground fabric courses and the wave portion courses.

16 Claims, 3 Drawing Sheets

(56) References Cited

U.S. PATENT DOCUMENTS

| | | | | | |
|---|---|---|---|---|---|
| 4,014,188 | A * | 3/1977 | Conti | D04B 9/46 | 66/172 R |
| 4,149,274 | A * | 4/1979 | Garrou | A41B 11/008 | 2/239 |
| 4,195,497 | A * | 4/1980 | Goldstein | A41B 11/00 | 66/178 R |
| 4,494,388 | A * | 1/1985 | Lau | D04B 1/265 | 66/178 A |
| 4,745,917 | A * | 5/1988 | Hasty | D04B 1/265 | 602/63 |
| 4,941,331 | A * | 7/1990 | Cournoyer | D04B 1/104 | 66/196 |
| 7,587,915 | B2 * | 9/2009 | Kaneda | D04B 1/26 | 2/239 |
| 9,603,748 | B2 | 3/2017 | Valois et al. | | |
| 2007/0033711 | A1 | 2/2007 | Achtelstetter | | |

* cited by examiner

KNITTED PART

CROSS-REFERENCE TO RELATED APPLICATIONS

The present application claims priority of EP 16 170 264.2, filed May 19, 2016, the priority of this application is hereby claimed and this application is incorporated herein by reference.

BACKGROUND OF THE INVENTION

The invention relates to a knitted part flat-knitted from at least one ground knitting thread.

A knitted part of this type is known in a very wide variety of forms, for example in the form of a stocking, in the form of a pantyhose, in the form of an abdominal part and the like. In addition to its being constructed as a circular knit, the knitted part is also known to be fabricated as a flat knit. It is occasionally desired or therapeutically advantageous for the knitted part to exert an at least local massaging effect on the human body. A merely illustrative example of a therapeutically relevant application is the production of a massaging effect for the purpose of treating plantar fasciitis, a disorder of the aponeurosis plantaris, which is associated with pain in the bottom of the foot, at the site of transition into the heel. In order to achieve such a massaging effect, EP 0 919 145 A2 for example discloses knitting the knitted part at least locally in a quasi three-dimensional manner, i.e., to knit so as to form local elevations directed towards the wearer. Since knitted parts of this type typically fit the wearer relatively closely, a minimally increased pressure due to the elevations directed towards the wearer will thus come about in the three-dimensionally knitted region, so these elevations do altogether produce a slight massaging effect as the body part in question moves. Yet prior art knitted parts of this type are disadvantageous in that the magnitude of these elevations is but relatively minimal, meaning that the elevations project but minimally out of the surface of the knitted part, so the massaging effect is likewise relatively minimal.

SUMMARY OF THE INVENTION

The problem addressed by the invention is therefore that of devising a knitted part which is improved over the prior art and which enables the formation of more prominently projecting elevations.

To solve this problem, the invention provides a knitted part flat-knitted from at least one knitting thread, said knitted part comprising a ground fabric portion comprising a plurality of ground fabric courses, and also at least one wave portion which extends across a plurality of wales, which comprises a plurality of wave portion courses and in which, in each case, a loop has been knitted in a first wale in a first wave portion course and at least one further wave portion course, whereas, in each case, in a second wale, a loop knitted in the first wave portion course extends across a plurality of wave portion courses, wherein at least one elastic weft thread runs through at least a proportion of the ground fabric courses and the wave portion courses.

The knitted part of the invention is notable for the formation of one or more defined wave portions which display/form, on the inside, i.e., on that side of the fabric which faces the wearer, the elevations which protrude out of the plane of the knitted part relative to the actual ground fabric portion. The/every wave portion extends across a plurality of wales, i.e., has an appropriate width. Said wave portion is formed from a plurality of mutually adjoining wave portion courses. Two different forms of wales are formed within every wave portion, and which, for example, adjoin each other neighboringly, namely a first wale and a second wale. In the first wale, a loop is knitted at least in the first course and at least one further course, preferably in every wave portion course, i.e., individual loops adjoin each other in two, three or more or every course in the direction of the wales. A second wale is knitted in the wave portion, for example neighboringly to the first wale. In this second wale, a loop is knitted in a first wave portion course to extend across a plurality of wave portion courses, i.e., to overbridge at least the second, optionally also the third or fourth wave portion courses and to only be intermeshed thereafter. Whereas, therefore, a plurality or all of the loops are knitted in the first wale, it is the case that, in the second wale, the first loop or to be more precise the loop of the first wave portion course is held by the needle during the knitting of the plurality of courses and is only knitted whenever a continuous wave portion course is being knitted again. Within this wave portion, for example, first and second courses can alternate, or a plurality of first courses are knitted side by side and followed by one or more second courses, or vice versa, ultimately any desired sequences of courses are conceivable. The overall result is an elongate wave portion. Therein the first and second wales can always lie in or be formed across the same wave portion courses, but they can also be mutually offset across courses, resulting in a kind of zigzag or wave pattern or the like, which is more specifically discussed hereinbelow.

The consequence of the knitted thread in the second wale stretching across a plurality of wave portion courses, i.e., of the loop elongating across a plurality of wave portion courses, and of the knitted thread having some inherent elasticity and being in a tensioned state in this "long" loop is that, in the ready-produced knitted part, the fabric in the wave portion will contract in the direction of the wales, which results in the formation of the elevation.

The invention, then, further provides that an elastic weft thread runs through at least a proportion of the ground fabric courses and at least a proportion of the wave portion courses. Thus, an elastic weft thread is additionally included in the ground fabric and also especially in the wave portion, and endows the knitted part with a level of elasticity ranging all the way up to compressive properties. This elastic weft thread is stretched in the donned position and is necessarily inclined to contract. As a result, the knitted fabric in the wave portion contracts even further than due to the "long" loops in the second wale, hence therefore enhancing the elevation and/or amplifying the prominence of its projection beyond the plane of the knitted part. The elastic weft thread thus leads to an improved formation of such an elevation in the wave portion. This in turn leads to the knitted part being able to develop, in the wave portion, an exceedingly better massaging effect than previously known knitted parts of this type.

As to how the weft thread is incorporated in the wave portion, different embodiments are conceivable. In a first embodiment of the invention, therefore, the weft thread in the wave portion course or courses may float in the second wale. The elastic weft thread is in any case floating in the ground fabric, i.e., it runs free-floatingly through the ground fabric courses. In precisely this way, it may also float in the wave portion course or courses, depending on whether it passes through every or every second wave portion course. Therefore, in the donned position of the knitted part, there is some contraction in the transverse or circumferential direction of the knitted part, resulting in its contracting, for elevation formation, not only in the fabric longitudinal direction by virtue of the knitted thread of the "long" loops being stretched in the direction of the wales but also transversely thereto by virtue of the elastic weft thread.

A particularly advantageous alternative or further development provides by contrast that the weft thread runs at least through the first wave portion course and floats across the loop, which extends across a plurality of wave portion courses, of the particular second wale. In this embodiment of the invention, the elastic weft thread is quasi carried along the second wale, and held on the same needle, together with the ground fabric knitting thread of the "long" loop; that is, the weft thread is likewise guided/stretched longitudinally in the direction of the second wale. This already happens during the knitting process. The weft thread is accordingly not only somewhat stretched in the transverse direction in the second wale, since, coming from the first wale, it runs through the second wale and in turn to the neighboring next first wale. In addition, however, the weft thread is also stretched in the direction of the second wale especially. The overall result is therefore some tension in the transverse direction and especially in the longitudinal direction, i.e., in the direction of the wales. Since the elastic weft thread is significantly more elastic than the ground fabric knitted thread, therefore, a respectably high power of elastic recovery builds up within the second wale. This power causes the wave portion to contract to a considerably greater extent within the wales; that is, the incorporation of the elastic weft thread in the second wale across the "long" loop and hence the stretching in the fabric's longitudinal direction results in a distinctly enhanced development of the elevations, which is particularly advantageous for an enhanced development of the massage effect.

When the weft thread is inlaid in the first wave portion course and carried in the manner described across a plurality of wave portion courses together with the "long" loop, different further developments are conceivable for guiding the elastic weft thread through the neighboring further wave portion courses. A first alternative provides that the weft thread may run through one or more further wave portion courses and float in the second wale. Relative to the second wale, therefore, the elastic weft thread of the first wave portion course is quasi longitudinally tensioned in the direction of the wales and carried floatingly across the "long" loop of the ground fabric knitted thread. The elastic weft threads of the second, third, etc., wave portion courses, by contrast, are floating in the second wale. Thus, there is a larger elastic volume of thread within the wave because the elastic weft thread is guided through in virtually every wave portion course, resulting in principle in greater contraction, particularly here in the transverse direction, since the weft threads of the further wave portion courses are floating in the second wales.

It is alternatively conceivable that the weft thread runs through one or more further wave portion courses, wherein the weft thread of one or all further wave portion courses floats across the loop, which extends across a plurality of wave portion courses, of the particular second wale. In this alternative embodiment of the invention, therefore, the weft thread is likewise inlaid in one or more further wave portion courses. However, the weft thread does not float through the second wale, but is likewise longitudinally stretched in the direction of the second wale and, like the weft thread of the first wave portion course, is likewise made to float across the "long" loop of the ground fabric knitted thread of the second wale. When, therefore, the wave portion has three wave portion courses wherein an elastic weft thread passes through in each case, the "long" ground fabric loop in the second wale will extend across the second and third courses for example. The elastic weft thread of the first, second and third courses is then carried over the same needle as this "long" loop and is accordingly stretched in the direction of the wales while floating in each case across this loop. Therefore, a plurality or all of the weft threads end up being stretched in the direction of the wales, further enhancing the effect of the contraction in the direction of the wales. The development of the elevation is yet further augmented as a result, and the elevation is yet also "stabler" as it were, since the plurality of stretched weft threads develop a respectably high power of elastic recovery, which stabilizes the knitted elevation or wave.

Like the elastic thread in the wave portion courses and/or the second wales, the knitted thread may also be incorporated in various ways in the wave portion and/or especially in the particular second wale. It may be provided that the knitting thread of at least one or all further wave portion courses, in the particular second wale, likewise extending across one or more wale portion courses, floats across the loop, which extends across a plurality of wave portion courses, of the particular second wale. The knitted thread may thus likewise be tensioned in the fabric's longitudinal direction by being made to float across the "long" loop of the second wale. In fact, just the knitted thread of one or a few wave portion courses may be guided floatingly across the "long" loop; in the other courses, it is lying floatingly. Alternatively, the knitted thread of every wave portion course may float across the "long" loop. As a result, the entire potential force of elastic recovery due to the "long" loop, the stretched elastic thread or threads and the stretched knitted thread or threads in the particular second wale can be varied. Therefore, in a manner which also depends on the number of wave portion courses, any desired variations are possible as regards the manner of guiding the knitted thread and the elastic thread.

As described above, first and second wales may for example alternate more or less. The specific geometry within the knitted fabric is freely adjustable. It may thus be provided that a plurality of first and second wales knitted from the same wave portion courses are knitted in an alternating manner. This accordingly results in a riblike elevation running in a quasi straight-line manner in the transverse direction of the knitted part. It is alternatively conceivable to knit a plurality of first or second wales side by side, which are followed by one or more second or first wales. Any desired wale sequences are possible in the final analysis. It is alternatively conceivable that sub-portions comprising one or more pairs formed of one first and one second wale or comprising just first or just second wales are knitted with mutual offset in the direction of the wales. Unlike the riblike design described above, a zigzag- or wave-shaped elevation geometry can be knitted in this way. Every sub-portion may consist of a single pair of a first and second wale, in which case two neighboring pairs may be arranged to be mutually offset, for example by one or two courses. Moreover, every sub-portion may comprise just first or just second wales. Depending on the direction of the offset, a corresponding zigzag or wave pattern can thus be formed. It is conceivable in this connection that in the fabric transverse direction, the sub-portions adjoin each other directly, i.e., a first wale therefore always follows a second wale. But it is also conceivable that the sub-portions are separated from each other by one or more wales. It will be appreciated that, viewed in the fabric transverse direction, a straight elevation geometry, i.e., riblike elevations, may also allow for a plurality of such elevations to be knitted neighboringly to each other but separated from each other by one or more wales.

It is further conceivable to form a plurality of separate wave portions offset in the fabric longitudinal direction, i.e., in the direction of the wales. This means that between two such elevations in the direction of the wales, there are one, two, three or more knit courses which are not intended to serve the purpose of elevation formation. In this way, therefore, elevations, which are spaced apart by depressions, may also be formed in a manner spaced apart in the fabric longitudinal direction.

A particularly advantageous further development provides that, between (viewed in the direction of the wales) the ground fabric portion and the wave portion, a transition portion extending across a plurality of wales and courses is formed with a greater stitch density than the adjacent ground fabric portion. In this embodiment of the invention, the stitch density in a specific type of transition portion formed between the ground fabric portion and the wave portion is high. The stitch density is higher than in the neighboring ground fabric portion. This transition portion is designed to make available a large mesh volume which enables a lengthwise equalization to rectify the fabric shortening resulting from the knitted elevation or elevations. As described, the fabric contracts, especially in its longitudinal direction, in the region of the particular elevation owing to the stretched ground fabric thread and also, especially, the stretched weft thread or threads. To avoid unsightly bunching in the knitted part and/or the formation of openings in the fabric, the invention provides that this transition portion be knitted with a high mesh volume which compensates this fabric shortening. Such a transition portion is preferably formed here not only before but also after the or every wave portion. When, therefore, a multiplicity of mutually spaced-apart wave portions are knitted viewed in the longitudinal direction of the fabric, a transition portion will occur before the first wave portion and after the last wave portion as well as between any two neighboring wave portions, so overall a respectably high mesh volume is available for length equalization.

In this connection, the transition portion should extend across the same number of wales as the particular wave portion, so a sufficient mesh equalization volume is always available across the full wave portion width.

As described, the stitch density and/or the number of needle loops is greater in the transition portion than in the neighboring ground fabric portion. It is of course preferred that in the transition portion, every loop in every course is a knitted loop, so the mesh volume is maximized. The mesh volume knitted in the ground fabric portion, by contrast, is lower. For example, in the ground fabric portion, every loop in a first course is a knitted loop, while every second loop extends all the way into the following second course, whereas every second loop in the second course is a knitted loop, wherein the first and second courses alternate in the direction of the wales. Since every second loop of the first ground fabric courses all extend into the second ground fabric course, i.e., elongated loops are likewise formed, and accordingly only every second loop is knitted in the second group fabric course, the ground fabric portion will in consequence have a reduced mesh volume. When every loop, then, is knitted in the transition portion, a distinctly higher mesh volume will result there. However, the knitting pattern described for the ground fabric portion is merely illustrative in that, as will be appreciated, other knit constructions are also conceivable. Yet the governing principle is that when a transition portion is knitted because this is made necessary by the stitch density in the ground fabric portion, the stitch density or number of needle loops in the transition portion is greater than in the ground fabric portion.

As described above, the invention provides that the knitted part includes at least one elastic weft thread. This elastic weft thread, which may be, for example, a silicone or elastane thread, wrapped or unwrapped, endows the knitted part with a sufficient level of elasticity. It is preferable to use a weft thread and/or manipulate such that it endows the knitted part with a compressive property, i.e., that the knitted part is accordingly a compressive knitted part. Such a compressive knitted part builds up a defined pressure on the enclosed body tissue, additionally combined with the enhanced massaging effect provided by the invention by virtue of the invention providing an improved development of elevation or waviness.

The knitted part may be, for example, a stocking or a pantyhose, wherein the wave portion or portions are provided in a portion occupying the bottom of the foot in the donned position. This makes it possible in particular to treat the plantar fasciitis condition already described in the introductory part. Alternatively, however, it is also conceivable to construct the knitted part as an arm stocking, as an abdominal or upper part or as a pant, in which case the particular knitted part will be sufficiently elastic to conform to the body of the wearer. It is preferable for the knitted part to have compressive properties irrespective of how specifically it is unimplemented.

The knitting thread itself may be any desired knitting thread, for example of PA, PP or PE or a natural fiber such as cotton or silk, this enumeration not being exhaustive. The same holds for the use of the elastic thread in the form of a silicone or elastane thread.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
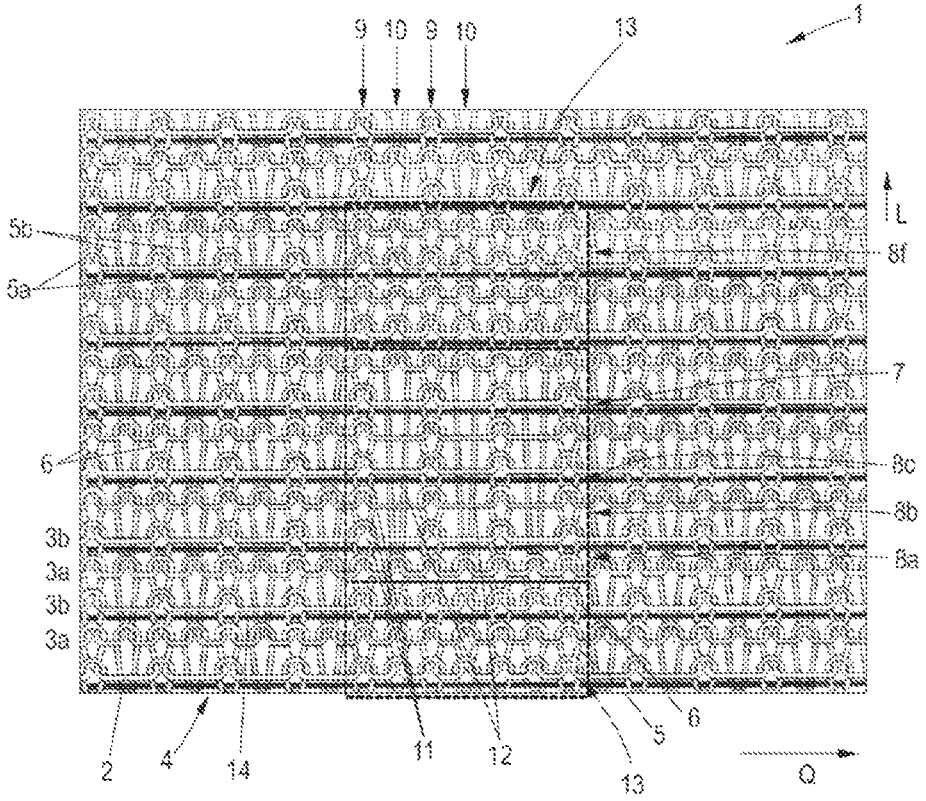
FIG. 1 shows a stitch pattern excerpted from a knitted part in a first embodiment.

FIG. 1 shows at 1 a knitted part of the invention in a first embodiment, as a partial view in the form of a stitch pattern. The knitted part 1 in the depicted example is formed as a flat knit from at least one knitting thread 2. It comprises a multiplicity of mutually adjoining ground fabric courses 3*a*, 3*b*, which mutually alternate in the fabric longitudinal direction L. These ground fabric courses form the ground fabric portion 4. In the depicted working example of FIG. 1 every ground fabric course 3*a* is knitted such that, while every loop is knitted, the loops 5*a* only extend to the next course 3*b*, whereas the loops 5*b* extend into the subsequent next but one course 3*a*, i.e., overbridge a course 3*b*. In consequence, it is necessarily only every second loop 6 which is knitted in every second ground fabric course 3*b*, since the elongated loop of the first ground fabric course 3*a* extends between two loops 6. The mesh volume reduces somewhat in the ground fabric portion 4 as a result.

The invention provides a wave portion 7, which is likewise knitted from the knitted thread 2. It consists of a plurality of wave portion courses 8*a*, 8*b*, 8*c* . . . 8*f*, where the wave portion course 8*a* is the first wave portion course whereto the other wave portion courses 8*b*, 8*c*, etc. adjoin. The wave portion courses adjoin the ground fabric courses 3*a*, 3*b*.

The wave portion 7 consists of a plurality of separate wales, namely pairs comprising a first wale 9 and a neighboring second wale 10. The wave portion 7 is both-sidedly terminated by a first wale 9. In the example shown, a loop 11 is knitted in every first wale 9 in every wave portion course 8*a*, 8*b* . . . It is thus the case that, in the direction of wale 9, a loop 11 is followed by a loop 11.

The second wale 10 is distinctly different from this, however. The second wale 10 ultimately only has one "long" loop 12. The knitted thread 2 is "pulled" therein from the first wave portion course 8*a* across a plurality of further wave portion courses through to the last wave portion course 8*f*; that is, the loop of wave portion course 8*a* is held on the needle during the knitting action. Said loop is not knitted until the last wave portion course 8*f* is being knitted. The result is a longitudinal stretching of the knitted thread 2 due to the "long" loop 12. The latter tends to recontract somewhat owing to the thread elasticity, resulting in the formation of an elevation or bulge on the inside, i.e., on that side of the fabric which faces the wearer. A plurality of pairs consisting of first and second wales 9, 10 are seen to alternate within the wave portion 7.

There are further provided two transition portions 13, bordered by a broken line in FIG. 1, as is the wave portion 7. In these transition portions 13, the courses coming from the ground fabric courses, are knitted with a higher number of needle loops than in the actual ground fabric portion 4. As is clearly shown by FIG. 1, every loop 5, 6 is knitted here, so the mesh volume here is maximized. Thus the stitch density will be higher in every transition portion 13 than in the ground fabric portion 4. This increased number of needle loops ensures that every transition region 13 can serve as "length equalizer" as a result of the fact that due to the longitudinal stretching of the knitted thread 2 in the particular wale 10, i.e., the "long" loops 12, the wave portion is contracted in the fabric longitudinal direction L. Enlarging the mesh volume before and after wave portion 7 can thus ensure that contraction of wave portion 7 notwithstanding, the fabric does not distort or form small holes or the like.

The knitted part 1 further comprises at least one elastic weft thread 14 which, in the working example shown in FIG. 1, floats through every second course, whether ground fabric courses 3*a* or wave portion courses 8*a*, 8*c*, etc., are concerned. This elastic weft thread endows the ground fabric 1 with a sufficient level of elasticity all the way through to compressive properties. It enhances the development of the elevation in the particular wave portion 7 once it has been somewhat stretched longitudinally during knitting. It thus contracts somewhat in the fabric transverse direction Q, which is ultimately beneficial to the development of the elevation in the wave portion 7, since there will precisely also be a transverse contraction component in addition to the longitudinal contraction of the "long" loops 12.

Figure 2:
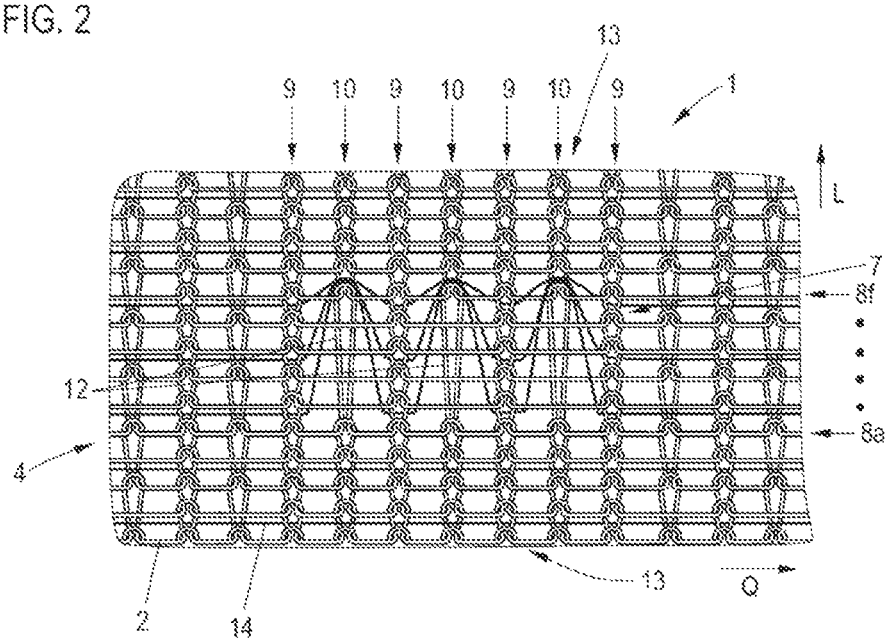
FIG. 2 shows a stitch pattern excerpted from a knitted part in a second embodiment

FIG. 2 shows a knitted part 1 of the invention in a second embodiment that corresponds in terms of basic construction to the knitted part 1 of FIG. 1. It likewise has a ground fabric portion 4 formed from corresponding ground fabric courses, knitted in the differing way described. Again there is provided a wave portion 7 plus—therebefore and thereafter—transition portions 13 of increased stitch density as compared with the ground fabric portion 4. The knitted part 1 is again knitted from a knitted thread 2 and also the inlaid elastic thread 14. The elastic thread 14 again runs as inlaid weft thread through—by way of example—every second course. It is in each case floating therein.

A difference resides in the region of wave portion 7, as FIG. 2 clearly shows. It is apparent that the elastic thread 14 of the particular courses in the particular second wale 10 is not running floatingly through the course; instead it is likewise held on that needle on which the "long" loop 12 of the particular second wale 10 is held. In the illustrated example, quasi three elastic threads conjointly float across the particular "long" loop 12 in the particular second wale 10.

As FIG. 2 clearly shows, the elastic weft threads 14 of the individual courses of wave portion 7 are therefore also longitudinally stretched to different extents in the fabric longitudinal direction L. Since elastic thread material is concerned, the elastic thread 14 will accordingly develop a power of elastic recovery and have a tendency to contract. As a result and because the tensioning is primarily in the fabric longitudinal direction L, the knit will contract much more strongly in the longitudinal direction L in wave portion 7 than in the case of the embodiment in FIG. 1. A certain amount of transverse contraction likewise occurs here.

The knitted part as per FIG. 1 therefore displays a much more prominent development of elevation than the knitted part 1 of FIG. 1.

In the embodiment of FIG. 2, the knitted thread in the second wales 10 of wave portion 7 is floating in each of wave portion courses 8*b* etc., as FIG. 2 clearly reveals. It is only the elastic weft threads 14 of the individual rows which are elongated in the longitudinal direction L and float across the "long" loop 12 in the particular wale 10.

Figure 3:
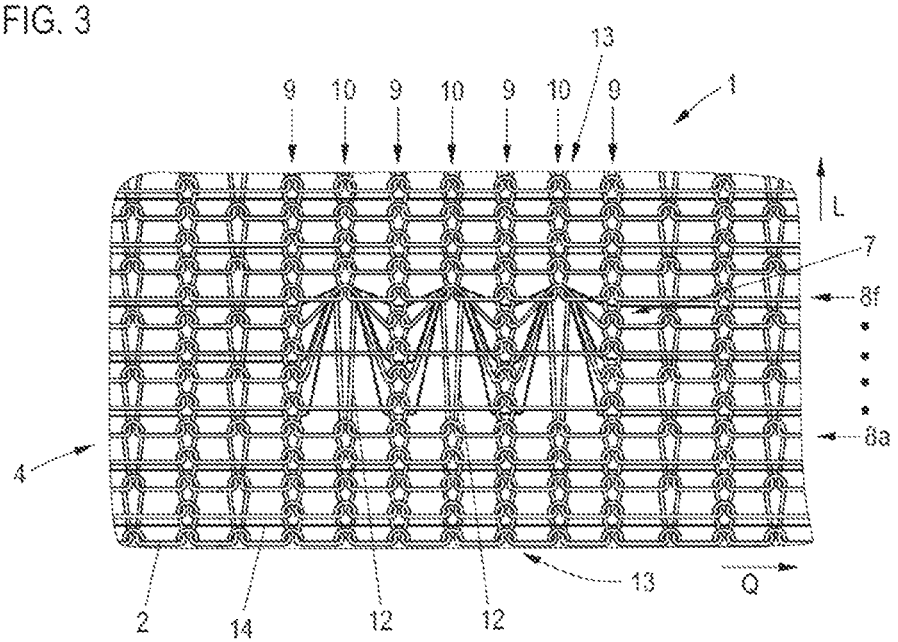
FIG. 3 shows a stitch pattern excerpted from a knitted part in a third embodiment.

The design is different with the knitted part 1 shown in FIG. 3 of the invention. This design corresponds to the design as per the stitch pattern of FIG. 2; that is, here too the elastic thread 14 in the particular second wale 10 floats across the "long" loop 12.

In the illustrated example of FIG. 3, however, the knitted thread 2 in every second course 8*b*, 8*d*, 8*f* also floats across the "long" loop 12, whereas in every other course 8*c*, 8*e* it floats across the second wale 10. As a result, in this embodiment, the knitted thread 2 is likewise stretched not just in the "long" loop 12 in the fabric longitudinal direction L in wave portion 7, but also in higher courses, since, as described, the knitted thread 2 floats across the long loop 12 in the fabric longitudinal direction L.

This makes the recovery capacity within the wave portion 7 somewhat greater still than in the embodiment of FIG. 2, where the recovery capacity is only due to the "long" loops 12 and also the stretched elastic threads 14. The embodiment of FIG. 3 additionally benefits from the recovery capacity of knitted thread 2 insofar it runs across the "long" loop 12 and does not float in wale 10.

Figure 4:
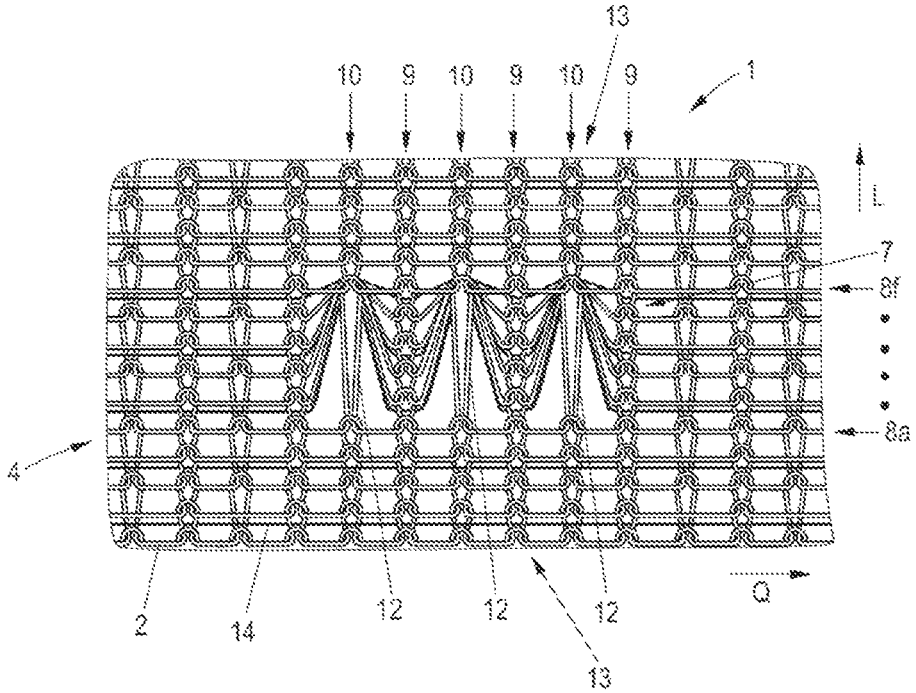
FIG. 4 shows a stitch pattern excerpted from a knitted part in a fourth embodiment.

FIG. 4 finally shows an embodiment featuring quasi "maximal" capacity for recovery. FIG. 4 continues the embodiment of FIG. 3 still further by the knitted thread 2 no longer floating within the particular second wale 10, but floating in every wave portion course 8*b*-8*e* across the loop of the "long" loop 12. It is therefore clear here that the knitted thread 2 is repeatedly stretched within the wave portion 7 as well as naturally also the elastic thread 14. The result here therefore is a very pronounced contraction within the wave portion 7, especially in the fabric longitudinal direction, and to some extent also in the fabric transverse direction.

A feature common to all the working examples is the transition portion 13, which precedes and follows the particular wave portion 7 and wherein a higher stitch density is knitted than in the ground fabric portion 4, as already described in the introductory remarks regarding FIG. 1. A "length equalizer" is thereby realized to compensate the fabric shortening resulting from the contraction in wave portion 7.

Although the knitted thread 14 in each of the described working examples of FIGS. 2-4 floats in the wave portion courses or across the "long" loop 12, it is also possible, as will be appreciated, to also have the elastic thread 14—in a manner similar to the knitted thread 2 in these embodiments—only partly cross the "long" loop 12, i.e., have it stretch in the longitudinal direction L, and to have it partly float in the second wale 10. The recovery capacity within the wave portion 7 in the fabric longitudinal direction can be further varied in this way.

The knitting thread may be for example a PA, PE or PP thread or natural thread based on cotton or silk. The elastic thread 14 is for example a silicone or elastane thread, which is wrapped or unwrapped.

It will be appreciated that any desired number of wave portions 7 may be formed within the knitted part 1 which may each also vary greatly in geometry or size. For example, a wave portion 7 may extend in the fabric transverse direction Q in a quasi straight line to form a transversal rib. A plurality of such ribs may be knitted in the fabric longitudinal direction L with a transition region 13 between any two such ribs/wave portions 7.

It is also conceivable to knit a wave or zigzag pattern within the wave portion 7, i.e., within the resulting elevation. In this case, the individual pairs consisting of the first and second courses 9, 10 would be knitted mutually offset in the fabric longitudinal direction, for example offset by one or two loops in each case, while the offsetting direction varies to knit a wave or a zigzag shape.

It is further possible for a plurality of separate wave portions 7 to be knitted neighboringly to each other in the fabric transverse direction Q; they are spaced apart from each other by one or more wales. In the final analysis, any desired geometric configuration is conceivable.

The knitted part 1 itself may for example be embodied as a leg stocking. The diverse wave portions 7 in this case are preferably knitted in the fabric region which covers the bottom of the foot in order to use that fabric region to produce a massaging effect, in order to be able to treat plantar fasciitis for example.

Alternatively, the knitted part may also be embodied as pantyhose or as arm stocking or as an abdominal part or the like. The wave portion or portions 7 are always produced in those places on the inside surface of the fabric where a massaging treatment of the enclosed tissue or body part is to be effected.

While specific embodiments of the invention have been shown and described in detail to illustrate the inventive principles, it will be understood that the invention may be embodied otherwise without departing from such principles.

I claim:

1. A knitted part flat-knitted from at least one knitting thread, said knitted part comprising a ground fabric portion comprising a plurality of ground fabric courses, and also at least one wave portion which extends across a plurality of wales, which comprises a plurality of wave portion courses and in which, in each case, a loop has been knitted in a first wale in a first wave portion course and at least one further wave portion course, whereas, in each case, in a second wale, a further loop knitted in the first wave portion course extends across a plurality of wave portion courses, wherein at least one elastic weft thread runs through at least a proportion of the ground fabric courses and the wave portion courses, wherein the weft thread runs at least through the first wave portion course and floats across the further loop, which extends across a plurality of wave portion courses, of the second wale, wherein a next elastic thread following the extended further loop, seen in a direction of the second wale, floats through a ground fabric loop.

2. The knitted part according to claim 1, wherein the weft thread in the wave portion course or courses floats in the second wale.

3. The knitted part according to claim 1, wherein the weft thread runs through one or more further wave portion courses and floats in the second wale.

4. The knitted part according to claim 1, wherein the weft thread runs through one or more further wave portion courses, wherein the weft thread of one or all further wave portion courses floats across the loop, which extends across a plurality of wave portion courses, of the second wale.

5. The knitted part according to claim 1, wherein the knitted thread of at least one or all further wave portion courses, in the particular second wale, likewise extending across one or more wale portion courses, floats across the loop, which extends across a plurality of wave portion courses, of the particular second wale.

6. The knitted part according to claim 1, wherein a plurality of first and second wales knitted from the same wave portion courses are knitted in an alternating manner.

7. The knitted part according to claim 1, wherein a plurality of wave portions are provided offset in the fabric longitudinal direction.

8. The knitted part according to claim 1, wherein, between, viewed in the direction of the wales, the ground fabric portion and the wave portion, a transition portion extending across a plurality of wales and courses is formed with a greater stitch density than the adjacent ground fabric portion.

9. The knitted part according to claim 8, wherein a transition portion has been formed not only before but also after the or every wave portion.

10. The knitted part according to claim 8, wherein the transition portion extends across the same number of wales as the wave portion.

11. The knitted part according to claim 8, wherein in the transition portion, every loop in every course is a knitted loop.

12. The knitted part according to claim 1, wherein in the ground fabric portion, every loop in a first course is a knitted loop, wherein every second loop extends all the way into the following second course, and in that every second loop in the second course is a knitted loop, wherein the first and second courses alternate in the direction of the wales.

13. The knitted part according to claim 1, wherein it is a stocking or a pantyhose, wherein the wave portion or portions are provided in a portion occupying the bottom of the foot in the donned position, or in that it is an arm stocking, an abdominal or upper part or a pant.

14. The knitted part according to claim 1, wherein a plurality of first and/or a plurality of second wales are knitted side by side.

15. The knitted part according to claim 1, wherein sub-portions comprising at least one pair formed of one first and one second wale or comprising just first wales or just second wales are knitted with mutual offset in the direction of the wales.

16. The knitted part according to claim 15, wherein in the fabric transverse direction, the sub-portions adjoin each other directly or are separated from each other by one or more wales.

* * * * *